US011198208B2

(12) United States Patent
Quesada Barbero

(10) Patent No.: US 11,198,208 B2
(45) Date of Patent: Dec. 14, 2021

(54) PLIERS FOR TIGHTENING PARTS FOR LEVELLING CLADDING TILES

(71) Applicant: GERMANS BOADA, S.A., Barcelona (ES)

(72) Inventor: Juan Antonio Quesada Barbero, Barcelona (ES)

(73) Assignee: GERMANS BOADA, S.A., Barcelona (ES)

( * ) Notice: Subject to any disclaimer, the term of this patent is extended or adjusted under 35 U.S.C. 154(b) by 207 days.

(21) Appl. No.: 16/528,750

(22) Filed: Aug. 1, 2019

(65) Prior Publication Data

US 2020/0086461 A1 Mar. 19, 2020

(30) Foreign Application Priority Data

Sep. 13, 2018 (ES) ..... ES201830886

(51) Int. Cl.
*B25B 7/12* (2006.01)
*E04F 21/20* (2006.01)
*B25B 7/04* (2006.01)

(52) U.S. Cl.
CPC ..... *B25B 7/12* (2013.01); *B25B 7/04* (2013.01); *E04F 21/20* (2013.01)

(58) Field of Classification Search
CPC .. B25B 7/08; B25B 7/10; B25B 13/04; B25B 13/12; B25B 7/02; B25B 7/04; B25B 7/12; B25B 7/14; B25B 7/18; B25B 7/20; B25B 13/02; B25B 13/14; B25B 13/5058; B25B 9/00; E04F 21/20
See application file for complete search history.

(56) References Cited

U.S. PATENT DOCUMENTS 2,084,633 A * 6/1937 Erickson ..... B25B 7/02 81/365
6,237,449 B1 * 5/2001 Orlosky ..... B25B 13/5058 30/101
8,056,446 B1 * 11/2011 Wheeler ..... B25B 7/04 81/58

FOREIGN PATENT DOCUMENTS

CN 204983579 * 1/2016
CN 107514126 * 12/2017
GB 000863441 * 3/1961
GB 002177647 * 1/1987

* cited by examiner

*Primary Examiner* — Robert J Scruggs
(74) *Attorney, Agent, or Firm* — Hodgson Russ LLP

(57) ABSTRACT

Pliers for tightening parts for levelling cladding tiles, including: a first arm (1) with a handle (10) and a guide bar (11); a second arm (2) with a handle (20) and a contact surface (21) with a levelling wedge; a rotation shaft (4); and a supporting stop (3) comprising: a passage (31) for assembly in the guide bar; a shaft (32) assembled in a longitudinal slot (12) of the guide bar for the longitudinal movement of the supporting stop (3) with respect to the guide bar (11) and the relative rotation thereof between a fastening position with a pawl (13, 34) and a longitudinal movement position of the supporting stop (3) with respect to said guide bar (11); and a spring (33) which tends to maintain the supporting stop (3) in the fastening position with respect to the guide bar (11).

5 Claims, 2 Drawing Sheets

PLIERS FOR TIGHTENING PARTS FOR LEVELLING CLADDING TILES

CROSS REFERENCE TO RELATED APPLICATION

This application claims priority to Spanish Patent Application No. P201830886, filed Sep. 13, 2018, the entire disclosure of which is incorporated by reference herein.

TECHNICAL FIELD

The invention relates to pliers for tightening parts for levelling cladding tiles, which are known in the market and are made up of a pushing wedge and a T-shaped levelling element.

These pliers are applicable in the construction sector, in particular, in jobs involving laying cladding tiles on diverse surfaces; and they have features which facilitate the adjustment of the pliers, without needing to use any tools, and correctly tighten the levelling parts, depending on the thickness of the tiles to be leveled.

PRIOR STATE OF THE ART

Patent EP2532806 (ES2598702T3) discloses a device for levelling rigid cladding plates arranged on a surface to be cladded, the device in question comprising a levelling element and a tightening wedge and a manual tool or pliers for the actuation thereof.

The levelling element, with a T-shaped cross section, comprises a flat base adapted to rest on the surface to be cladded, and a flat flange, perpendicularly joined to the base and provided in the lower portion thereof with a first opening wherein the wedge can be inserted and end notches to weaken it against shearing stresses.

The tightening wedge comprises a lower settling surface and an upper working surface, adapted to transmit a tensile stress towards the second element which tends to separate the levelling part from the surface; said working face having slots that define saw-like teeth, in order to stop the backward movement of the wedge with respect to the second element.

The manual tool comprises: a support equipped with a handle made of polymeric material on a first end and a graduated scale on a second end, in order to apply the suitable force depending on the height of the cladding tiles or plates; a support element, made of polymeric material, comprising a guide adapted to enable the movement thereof along the support and legs separated by an opening which enables the passage of the wedge and which are adapted to provide spacing between the support and the cladding plate and; a pusher made of polymeric material joined by means of a joint to the support and equipped with a first gripping portion and a second pushing portion for pushing the wedge by pivoting the support by means of the joint, causing stresses in order to separate the levelling piece and the surface to be cladded.

These pliers or tool, like other ones existing on the market, have fastening means for fastening the supporting stop in different positions along the support consisting of a screw assembled threaded into the supporting stop which exerts a pressure against the guide.

These fastening means have different drawbacks when used: difficulty of actuation when the operator is wearing protective gloves; need to use a tool for actuating the screw, especially when fastening paste of the tiles is deposited on the thread, the deterioration of the thread from wear due to frequent changes in position of the supporting stop; risk of unwanted movement of the supporting stop due to insufficient tightening of the fastening screw, and risk of it sliding along the guide bar of the support.

Therefore, the technical problem that arises is the development of pliers, of the type mentioned above, which satisfactorily solves the problems mentioned above relating to the fastening of the supporting stop with respect to the guide bar of the support.

DESCRIPTION OF THE INVENTION

The pliers for tightening parts for levelling cladding tiles object of the invention are of the type mentioned above and described in the preamble of the first claim. These pliers have features aimed at satisfactorily solving the problems described regarding the fastening of the supporting element in different positions, suitable for acting on the levelling parts and performing the levelling of tiles with different thicknesses.

Specifically, these pliers comprise: a first arm, straight, having a handle on a rear end and a guide bar on a front end for the movable assembly of a supporting stop of the levelling element; a second arm, at an angle, having a rear end provided with a handle and having a contact surface with the pushing wedge on a front end; a shaft for rotating the arms of the pliers and; means for fastening the supporting stop in different positions along the guide bar of the first arm.

To solve the problem described, and according to the invention, the supporting stop comprises: a passage with a height greater than the guide bar; a shaft assembled in a longitudinal slot of the guide bar and which enables the longitudinal movement of the supporting stop along the guide bar and the relative rotation thereof between a fastening position and a longitudinal movement position of the supporting stop with respect to said guide bar; and a spring which acts against a surface of the guide bar and tends to maintain the supporting stop in the fastening position with respect to the guide bar.

The means for fastening the supporting stop in several positions, longitudinally spaced with respect to the guide bar, are made up of a straight pawl comprising: a row of teeth defined along the guide bar, and a stop or tab assembled in the supporting stop and which: in the fastening position of the supporting stop is housed between any two consecutive teeth of the guide bar, and in the longitudinal movement position of the supporting stop is arranged spaced from the end of the teeth.

The spring assembled in the supporting stop tends to cause the rotation of said supporting stop towards a fastening position wherein the stop or tab is locked between the teeth of the guide bar, preventing said supporting stop from being moved longitudinally with respect to the guide bar.

In order to change the position of the supporting stop, it is sufficient to turn it manually, overcoming the resistance of the spring, until the stop or tab is released from the teeth, reaching a movement position wherein the supporting stop can run along the guide bar to the desired position, depending on the thickness of the tiles to be leveled.

Once this position is reached, it is sufficient to release the supporting stop so that the spring rotates it back to a fastening position and the stop or tab is locked between two consecutive teeth of the guide bar.

With these features the problems posed are satisfactorily resolved since: the change in position of the supporting stop does not require the actuation of any screws; this is very simple since it is sufficient to manually rotate the supporting stop until it is released from the teeth in order to move it along the guide bar; and the pawl ensures secure fastening of the supporting stop in the chosen position and prevents undesired movements thereof.

These and other additional features of the invention, set out in the appended claims, will be understood more easily in view of the embodiment example shown in the figures described below.

BRIEF DESCRIPTION OF THE CONTENTS OF THE DRAWINGS

As a complement to the description provided herein, and for the purpose of helping to make the features of the invention more readily understandable, the present specification is accompanied by a set of drawings which, by way of illustration and not limitation, represent the following:

DETAILED DESCRIPTION OF EMBODIMENTS OF THE INVENTION

Figure 1:
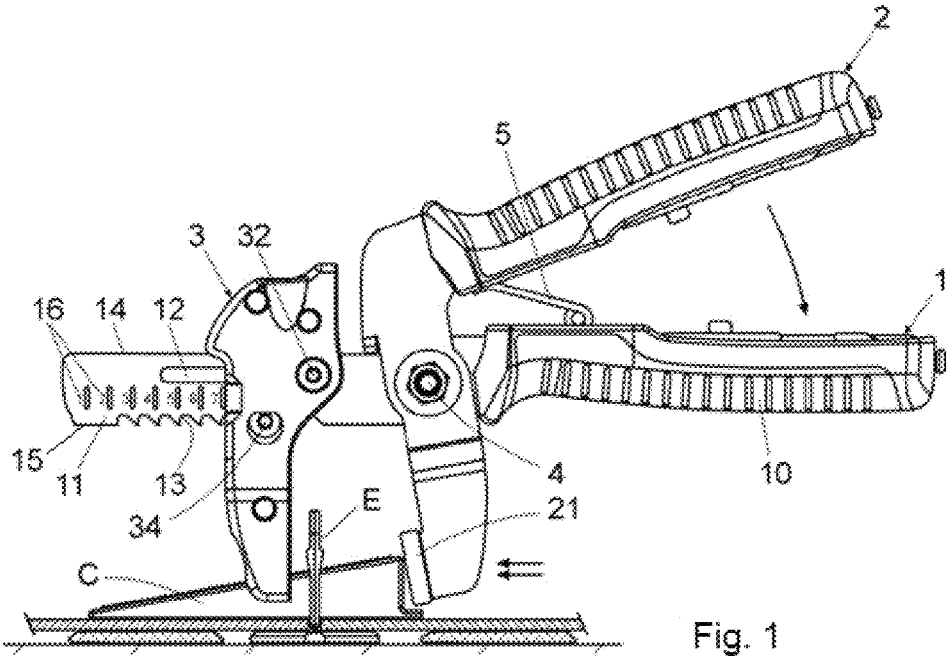
FIG. 1 shows an elevation view of the pliers of the invention during the tightening of a pushing wedge and of a tile-levelling element in opposite directions.

FIG. 1 shows the pliers for tightening parts for levelling cladding tiles, which act in opposite directions against a pushing wedge (C) acting on the tiles to be leveled and against a T-shaped levelling element (E) which is moved upwards due to the action of the inclined upper surface of the wedge, and which acts against the lower surface of the tiles pressing them against the lower surface of the wedge, performing the levelling thereof.

The pliers comprise: a first metal arm (1), straight, having a handle (10) on a rear end and a guide bar (11) on a front end for the movable assembly of a supporting stop (3) of the levelling element (E); and a second metal arm (2), at an angle, having a handle (20) on a rear end and a contact surface (21) with the push wedge (C) on a front end; said arms (1, 2) being related by a rotation shaft (4).

Figure 2:
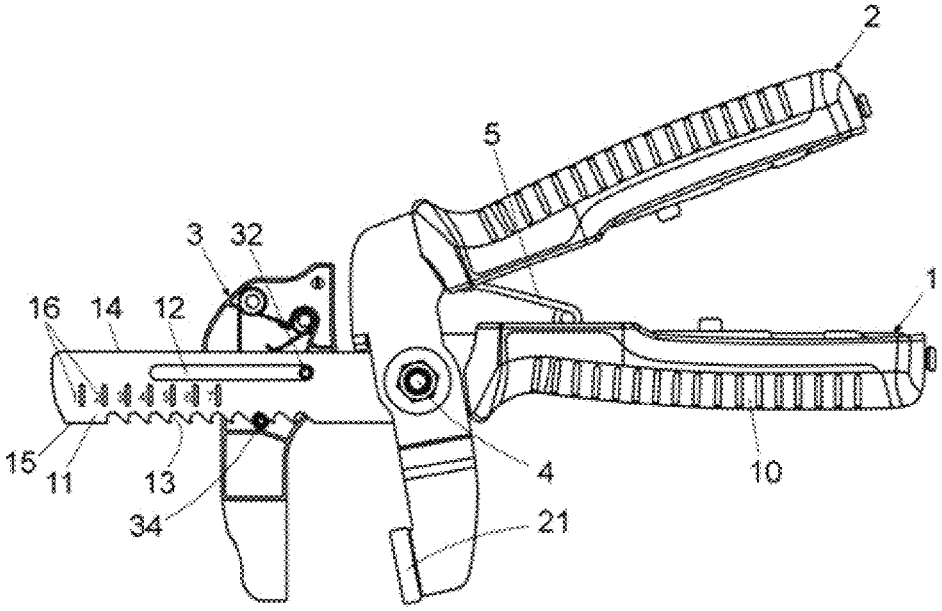
FIG. 2 shows an elevation view of the pliers of the previous figure, wherein the supporting stop has been shown in a fastening position and a vertical cross section has been performed in order to enable the visualization of the fastening elements thereof with respect to the guide bar.
Figure 3:
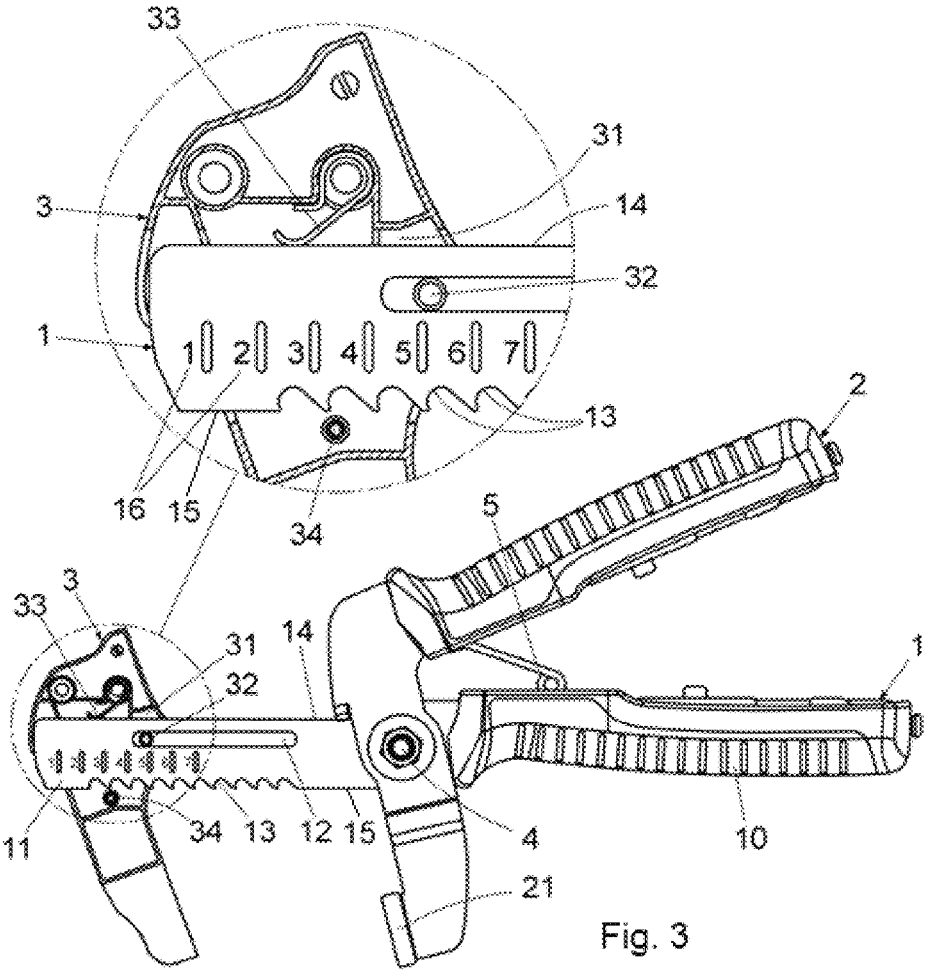
FIG. 3 shows an elevation view of the pliers, wherein the supporting stop has been shown in a longitudinal movement position with respect to the guide bar, released from the teeth of said guide bar.

The supporting stop (3) comprises a passage (31) with a height greater than the guide bar (11) and a shaft (32) assembled in a longitudinal slot (12) of the guide bar (11); said shaft (32) enables the longitudinal movement of the supporting stop (3) along the guide bar (11) and the relative rotation thereof between: a fastening position shown in FIGS. 1 and 2, and a longitudinal movement position of the supporting stop (3) with respect to said guide bar (11), shown in FIG. 3.

Said supporting stop (3) has a spring (33) which acts against a surface of the guide bar (11) and it tends to maintain the supporting stop (3) in the fastening position with respect to the guide bar (11) shown in FIGS. 1 and 2.

The means for fastening the supporting stop (3) in several positions, longitudinally spaced with respect to the guide bar (11), are made up of a straight pawl comprising: a row of teeth (13) defined along the guide bar (11), and a stop or tab (34) assembled in the supporting stop (3) and which: in the fastening position of the supporting stop (3) is housed between any two consecutive teeth (13) of the guide bar (11), and in the longitudinal movement position of the supporting stop (3) is arranged spaced from the end of the teeth (13).

As seen in the attached figures, the guide bar (11) has a first longitudinal edge (14) which makes up the supporting surface of the spring (33) of the supporting stop (3), and a second longitudinal edge (15), parallel to the previous one, wherein the row of teeth (13) of the pawl is defined.

To ensure that in the fastening position the supporting stop (3) is unable to move with respect to the guide bar (11), the teeth (13) of the guide bar (11) are inclined towards the rear end of the first arm (1) of the pliers, carrying the corresponding handle (10), meaning, in the direction opposite from the actuation of said supporting stop (3) against the levelling element (E).

The guide bar (11) comprises a graduated scale (16) indicating different fastening positions of the supporting stop (3) with respect to the row of teeth (13), for levelling tiles with different thicknesses.

These pliers have a spring (5) which acts against the first arm (1) and the second arm (2) and it tends to maintain the pliers in the open position, the arms (1, 2) recovering the position thereof when the manual pressure required for the actuation thereof is released.

Having sufficiently described the nature of the invention, in addition to a preferred exemplary embodiment, it is hereby stated for the relevant purposes that the materials, shape, size and layout of the described elements may be modified, provided that it does not imply altering the essential features of the invention claimed below.

The invention claimed is:

1. Pliers for tightening parts for levelling cladding tiles, with a pushing wedge (C) and a levelling element (E); the pliers comprising:

- a first arm (1), straight, having a handle (10) on a rear end and a guide bar (11) on a front end for a movable assembly of a supporting stop (3) of the levelling element (E);
- a second arm (2), at an angle, having a rear end provided with a handle (20) and having a contact surface (21) with the pushing wedge (C) on a front end;
- a rotation shaft (4) relative to the arms (1, 2) of the pliers; and
- a straight pawl for fastening the supporting stop (3) in different positions longitudinally spaced along the guide bar (11) of the first arm (1);

wherein the supporting stop (3) comprises:

- a passage (31) with a height greater than the guide bar;
- a shaft (32) assembled in a longitudinal slot (12) of the guide bar (11) and which enables a longitudinal movement of the supporting stop (3) along the guide bar (11) and a relative rotation thereof between a fastening position and a longitudinal movement position of the supporting stop (3) with respect to said guide bar (11); and
- a spring (33) which acts against a surface of the guide bar (11) and tends to maintain the supporting stop (3) in the fastening position with respect to the guide bar (11); and wherein the straight pawl comprises:

- a row of teeth (13) defined along the guide bar (11), and
- a stop or tab (34) assembled in the supporting stop (3) and arranged so that in the fastening position of the supporting stop (3), the stop or tab (34) is housed between any two consecutive teeth (13) of the guide bar (11), and in the longitudinal movement position of the supporting stop (3), the stop or tab (34) is arranged spaced from the end of the teeth (13).

2. The pliers, according to claim 1, wherein the guide bar (11) has a first longitudinal edge (14) which makes up a supporting surface for the spring (33) of the supporting stop (3), and a second longitudinal edge (15), parallel to the previous one, wherein the row of teeth (13) of the straight pawl is defined.

3. The pliers, according to claim 1, wherein the teeth (13) of the guide bar (11) are inclined towards the rear end of the first arm (1) of the pliers, carrying the corresponding handle (10).

4. The pliers, according to claim 1, wherein the guide bar (11) comprises a graduated scale (16) indicating different fastening positions of the supporting stop (3) with respect to the row of teeth (13) of the pawl, for levelling tiles with different thicknesses.

5. The pliers, according to claim 1, further comprising a spring (5) which acts against the arms (1, 2) of the pliers and tends to maintain the pliers in an open position.

* * * * *